United States Patent [19]

Gorini et al.

[11] 4,063,527

[45] Dec. 20, 1977

[54] MACHINE FOR STIFFENING PORTIONS OF SHEET MATERIAL

[75] Inventors: Robert Francis Gorini; Herbert Johnson; Frederick Stirling Sillars, all of Beverly, Mass.

[73] Assignee: USM Corporation, Boston, Mass.

[21] Appl. No.: 656,931

[22] Filed: Feb. 10, 1976

[51] Int. Cl.[2] ..... B05C 1/02

[52] U.S. Cl. ..... 118/5; 118/202; 118/238; 118/243

[58] Field of Search ..... 118/202, 4, 238, 5, 118/253, 7, 243, 263; 12/146 D

[56] References Cited

U.S. PATENT DOCUMENTS

| | | | |
|---|---|---|---|
| 3,277,867 | 10/1966 | Kilham et al. | 118/204 |
| 3,342,624 | 9/1967 | Kamborian | 118/2 |
| 3,653,356 | 4/1972 | Brastow | 118/7 |
| 3,759,219 | 9/1973 | Brastow | 118/204 X |
| 3,973,285 | 8/1976 | Babson et al. | 12/146 D |

*Primary Examiner*—John P. McIntosh

*Attorney, Agent, or Firm*—Carl E. Johnson; Richard B. Megley; Vincent A. White

[57] ABSTRACT

An improved machine and method for stiffening a selected portion of a sheet-like member generally flattens that portion, next deposits on a chill plate matrix an adhesive hot melt deposit of mostly uniform thickness except for a margin of added thickness for slower hardening, and then causes the matrix with impact to press all of the adhesive, while the added thickness margin is still softer than the uniform adhesive thickness, against the flattened portion of the member, thus transferring the adhesive to that portion, the added thickness margin being exuded laterally and hence taperingly reduced to provide diminishing stiffness toward an edge merging with the member.

The machine and method have particular advantage in stiffening a toe portion of a shoe upper, rendering the instep margin of the vamp or a toe piece free of irregularity, and assuring ultimate comfort for wearing in an assembled shoe.

19 Claims, 27 Drawing Figures

Fig. 2
Fig. 2a
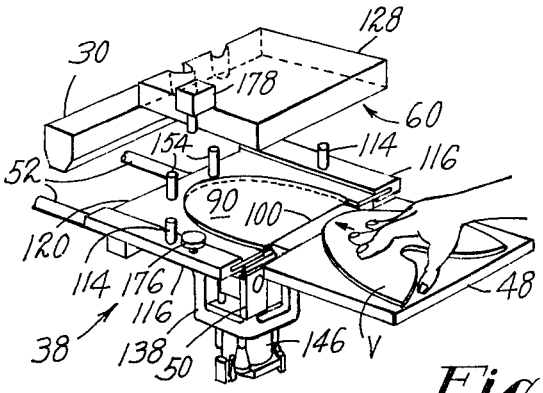
Fig. 2e
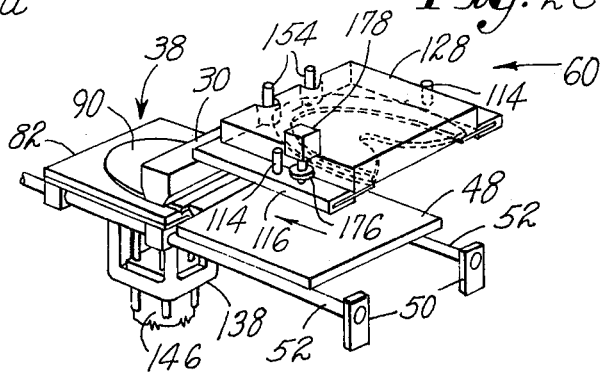
Fig. 2b
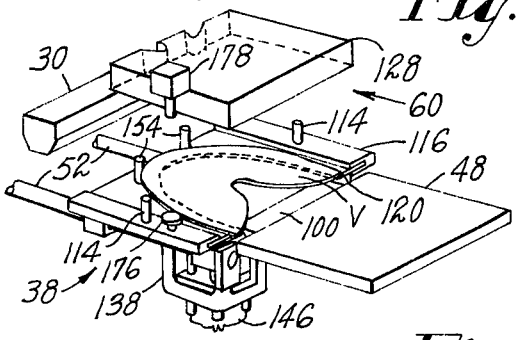
Fig. 2f
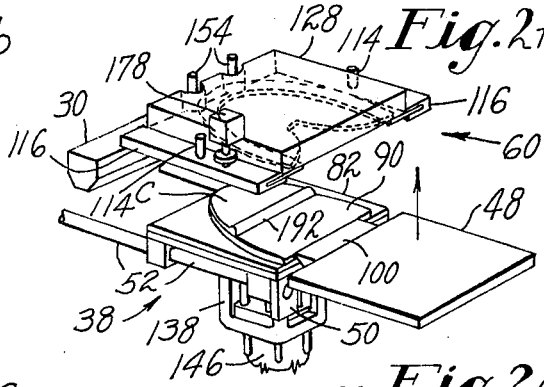
Fig. 2c
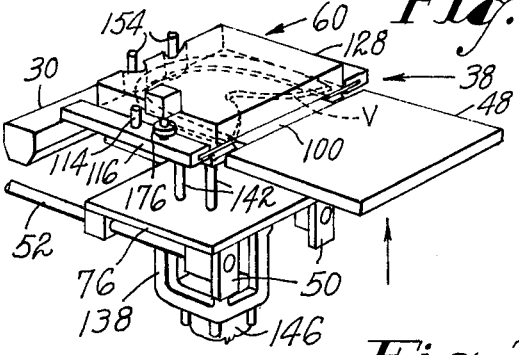
Fig. 2g
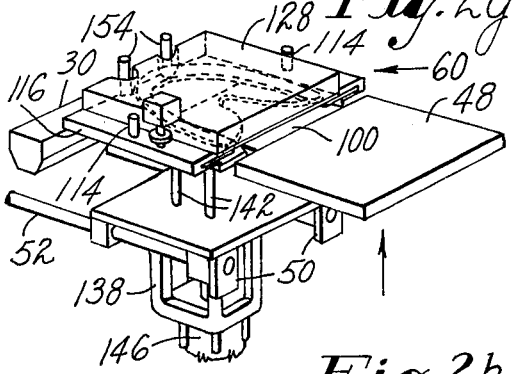
Fig. 2d
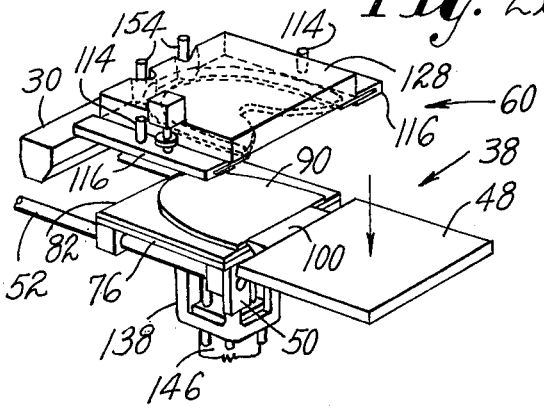
Fig. 2h
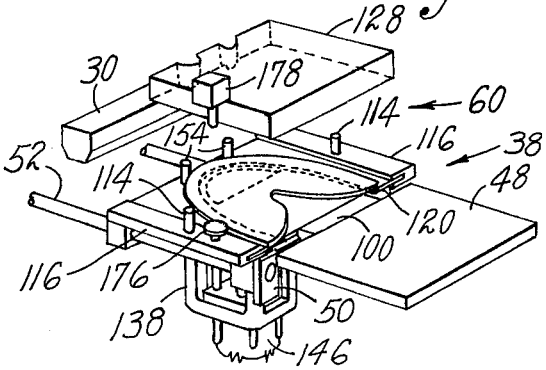

MACHINE FOR STIFFENING PORTIONS OF SHEET MATERIAL

CROSS REFERENCE TO RELATED APPLICATIONS

In application Ser. No. 538,819 filed Jan. 6, 1975, which issued Mar. 23, 1976, U.S. Pat. No. 3,945,074 Edward S. Babson et al., there is disclosed a machine for applying to predetermined portions of flexible material a hot melt adhesive which has previously been deposited on a chill plate having the configuration of the mentioned predetermined portion. Method aspects of the cited Babson et al. application are disclosed and claimed in a continuing application, Ser. No. 625,931 filed Oct. 28, 1975, now U.S. Pat. No. 3,973,285.

BACKGROUND OF THE INVENTION

This invention relates to providing a further improved machine and method for producing in flexible material, especially a shoe component, a stiffened selected area thereof.

The invention more particularly is concerned with combining a thermoplastic adhesive while still largely molten with a predetermined surface of the area to be stiffened in such a fashion that the surface, including any irregularities therein, is in effect not only rendered substantially smooth, but will have a portion of diminishing stiffness by reason of a portion of the adhesive being formed during transfer to the area, while soft, and thus caused to taperingly merge with the surface.

In the prior art the following disclosures may in various respects be deemed relevant amongst United States Letters Patent, for example:

U.S. Pat. No. 3,277,867 — Kilham et al., U.S. Pat. No. 3,605,151 — Maifeld et al., U.S. Pat. No. 3,616,573 — Chaplick et al., U.S. Pat. No. 3,442,743 — Schultz et al., U.S. Pat. No. 3,523,814 — Kamborian, U.S. Pat. No. 3,653,356 — Brastow and, U.S. Pat. No. 3,795,466 — Capuano So far as known, few if any of the machines suggested by these disclosures other than possibly those of Kilham et al. and Chaplick et al. have found general and very wide acceptance in industry probably because they commonly are inconvenient in operation and/or fail to suitably deal with both regular and irregular sheet material. An important aspect in which the method teaching of the Chaplick et al. patent, commonly owned by the assignee of this invention, is relevant is its disclosure that the molten adhesive desirably should have a viscosity low enough to wet and adhere to the surface to be stiffened and high enough that it will not substantially penetrate the shoe component being stiffened.

SUMMARY OF THE INVENTION

In view of the foregoing it is an object of this invention to provide an improved machine for stiffening selected portions of flexible work pieces, which machine shall also have convenience and versatility in operation for smoothing, in effect, such portions when desired.

Another object of the invention is to provide a novel machine for stiffening predetermined portions of work pieces by the application of thermoplastic adhesive in two alternative modes, i.e., relative translation of the work and an applicator means, or relative translation of a chill plate matrix and the applicator means, followed by relative movement of approach between the matrix and the work to transfer the adhesive from the matrix to the predetermined portion with a printing-on pressure.

A further and more specific object of the invention is to provide a machine for printing thermoplastic stiffening on predetermined portions of sheet material in a unique manner rendering the material generally smooth in such portions and with a margin of the stiffening tapered thus to diminish stiffness as the margin merges with a surface of the sheet material.

Advantageously, as herein shown, the present invention does not require inversion of the work presented to be coated, as is the case in the mentioned Babson et al. disclosure. Moreover, a machine according to the present invention, upon adjustment of certain parts, is capable of facile operation in either of two modes, namely: (1) for work of generally uniform thickness wherein, as heretofore, the work itself is moved in translation with respect to an applicator, as in the cited Kilham et al. disclosure, to progressively receive the desired adhesive coating; or (2) for uneven work especially, when an "overlaid" or printed-on adhesive is received by the work from a chill plate matrix which is itself relatively translatory to the applicator.

In accordance with a further feature of the invention as herein illustrated, novel utilization is made of adhesive applicator mechanism (largely structured as disclosed in the mentioned Kilham et al. patent), and modified controls therefor, not for the tilting of an applicator assembly relative to the work to impart a tapered or feather edge to deposited adhesive, but for causing the applicator assembly to initially dwell and be spaced from a heelward margin of the predetermined receiving area of a chilled matrix to be coated, thus creating a relatively thicker, slower cooling marginal bead or ridge of largely molten adhesive on the matrix, and thereafter moving the applicator assembly to a level closer to the matrix during relative translation to create over a major portion of the matrix an adjacent thinner, substantially uniform coating tending more quickly to cool and increase in viscosity while remaining molten in portions away from the chilled matrix. When the bead-carrying matrix is next registered with the work, which has advantageously been clamped in flattened, outspread condition, the matrix abruptly presses its coating, in "print-on" manner, against the work to cause the less viscous molten material of the bead to flow laterally beyond the original outline of the deposit to form a tapered margin important to attaining gradual diminution of the stiffening effect at the rear margin while avoiding any unseemly irregularity that could also prove uncomfortable in a shoe.

Further specific novelty is to be recognized in means provided for suitably holding an upper clamped outspread preliminary to receiving the thermoplastic as just indicated thus avoiding molding in of unwanted wrinkles or depressions. Another feature pertains to quick-disconnect work supporting means facilitating change over between different modes of operation and between different shapes of work pieces to be accommodated.

BRIEF DESCRIPTION OF THE DRAWINGS

The foregoing and other features of the invention, together with various novel details and combinations of parts, will now be more particularly described in connection with an illustrative embodiment, and with reference to the accompanying drawings thereof in which:

FIG. 2 includes, in sequence, perspective FIGS. 2*a* through 2*h* to diagrammatically show, respectively, the steps of one of the two alternative modes in which the machine of FIG. 1 is operable;

DESCRIPTION OF A PREFERRED EMBODIMENT

Figure 1:
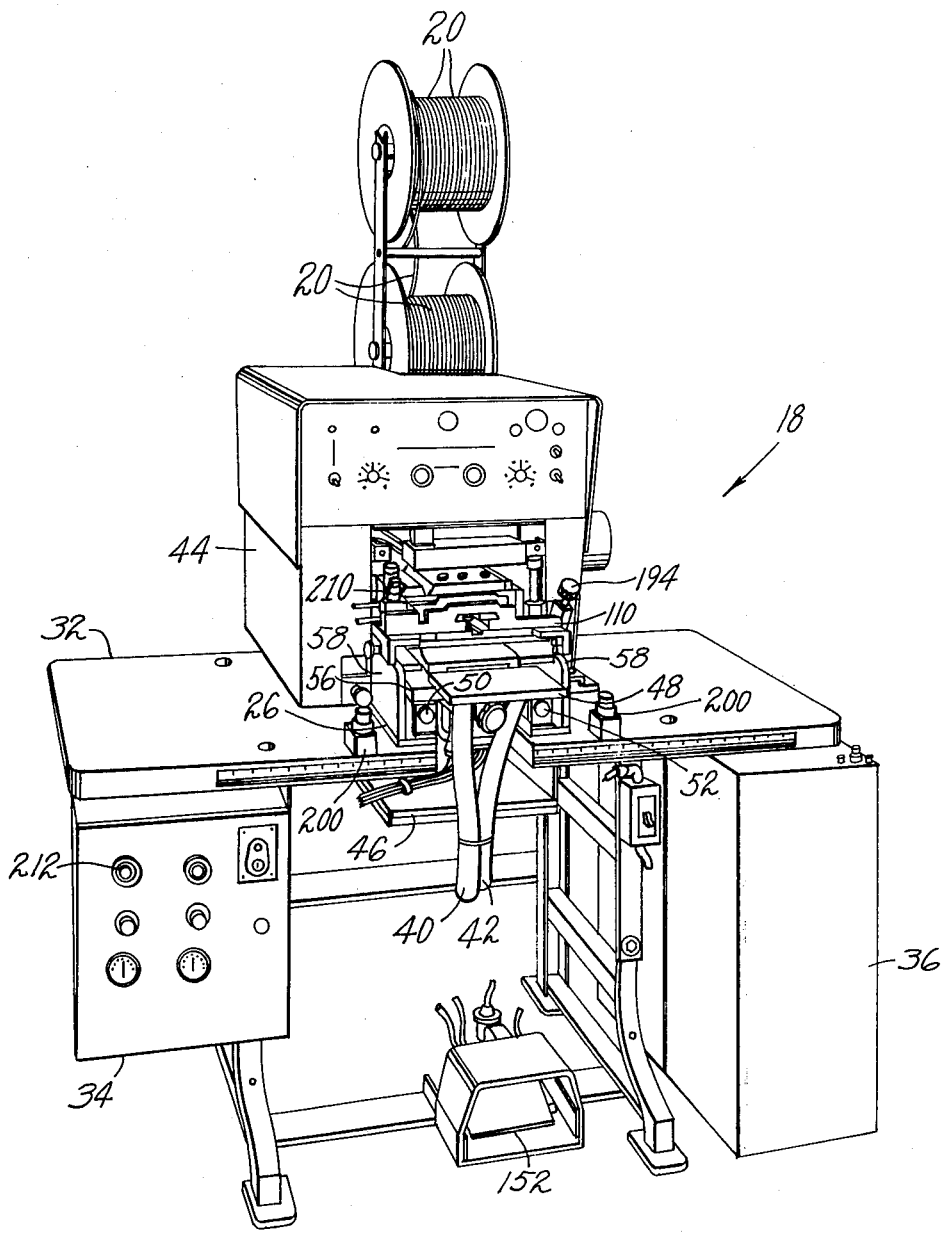
FIG. 1 is a perspective view of a pneumatically actuated, electrically controlled machine for stiffening selected portions of footwear components.

Referring to the drawings, FIG. 1 illustrates a machine generally designated 18 for stiffening predetermined components such as toe portions of a vamp or upper V (FIGS. 2 and 13) of a shoe, the machine sometimes being termed a "box toe applying machine". Although molten thermoplastic adhesive may be supplied by any suitable means, it is herein assumed for convenience and by preference that the adhesive be supplied progressively in the initial form of a flexible rod 20 to a melt body 22 (FIGS. 3 & 7) mounted on a frame 24 (designated 24 in the Kilham et al. patent). This frame is bolted on a base plate 26 (FIGS. 1, 3, 4–11). The body 22 may accordingly be part of a well known melting and feeding mechanism of the type, for instance, disclosed in U.S. Pat. No. 2,884,922 and be brought into and out of operating relation heightwise by a motor 27 (FIG. 7) corresponding to the actuator 186 of the Kilham et al. patent. It will be understood that the molten thermoplastic adhesive to be applied to the work will be delivered under pressure through a discharge hose 28 (FIG. 8) to an applicator device 30 in the body 22, which device along with other mechanisms herein referred to preferably (though not necessarily) largely conforms to that disclosed in the above-mentioned Kilham et al. U.S. Pat. No. 3,277,867. Because in some respects the structure fully disclosed in Kilham et al. resembles that herein to be explained, the areas of similarity will be only briefly described, and the areas incorporating significant distinction will be more fully detailed herein.

As shown in FIG. 1 the base plate 26 is secured upon a stand or bench 32 one side of which mounts a control panel 34 and the other side of which preferably supports are refrigerator and pump unit 36 for circulating a cooling medium, desirably a liquid, to and from a chill plate and main clamp assembly 38 (FIGS. 1–5) via hoses 40, 42 for purposes hereinafter to be explained. A protective housing 44 is detachably mounted over the melt body 20 and largely encloses the rear portion of the frame 24 as well as operating mechanism including work supporting and presenting means next to be described. Wiring and hoses may also be protected by a drip pan 46 (FIG. 1).

Figure 3:
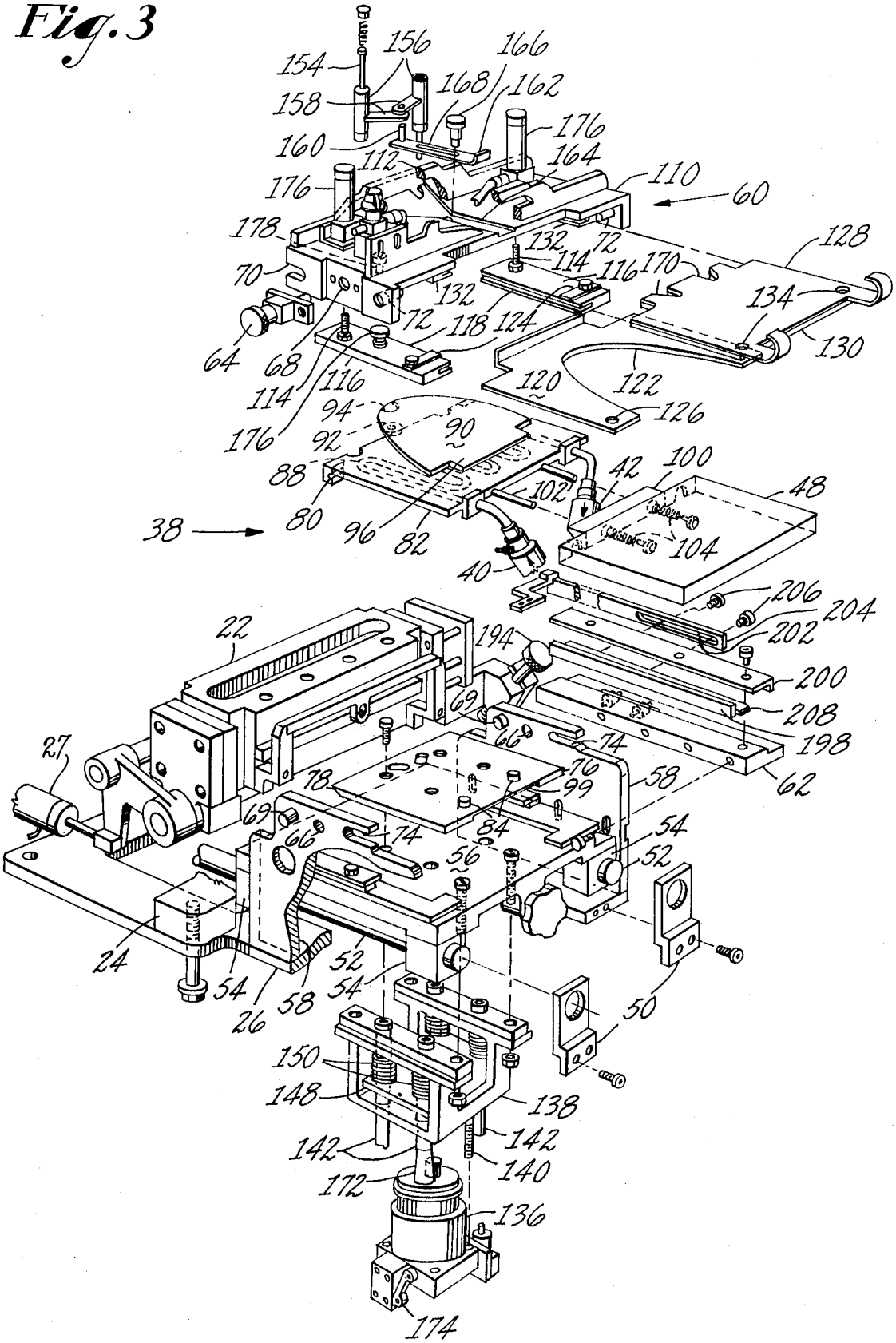
FIG. 3 is a exploded perspective view of the major operating parts shown in FIG. 2 including a work supporting and presenting table, an adhesive applicator assembly, a chill plate assembly including an interchangeable clamping matrix, and auxiliary work clamping and flattening means.
Figure 4:
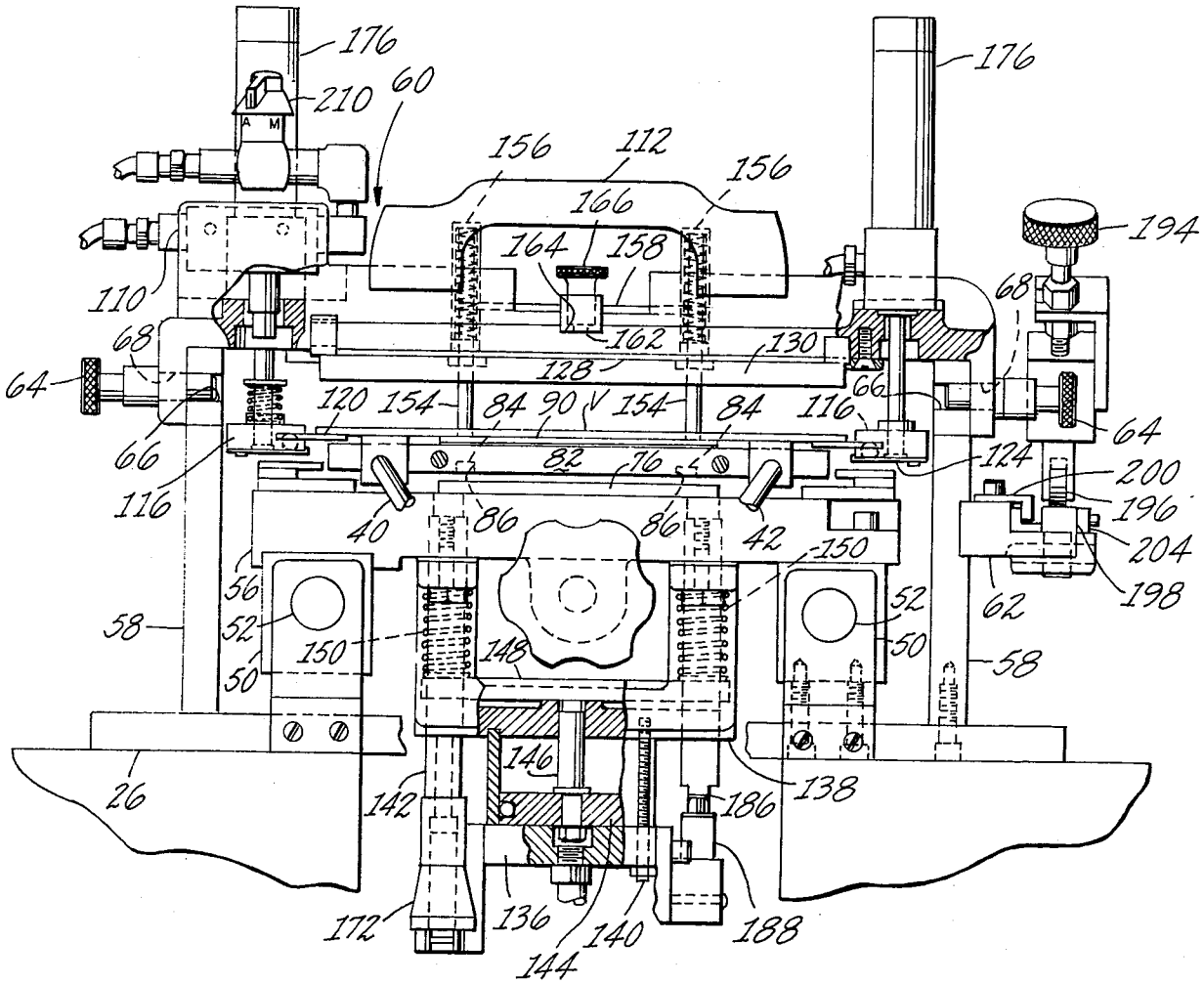
FIG. 4 is a view in front elevation partly in section, and on a larger scale, of the head portion of the machine shown in FIG. 1, the parts being in their initial or "down" position as shown in FIGS. 2*a* and 2*b;*

As indicated in FIG. 2*a,* a vamp V, with its external or finished side uppermost, and is to be stiffened in part is first place on a hollow, detachable work table portion 48 of the chill plate assembly generally designated 38 (FIGS. 2, 3, 6, 9) which is cyclically movable at time heightwise and at other times in translation toward and from the applicator device 30 by mechanisms to be explained. Referring especially to FIG. 3, brackets 50, 50 upstanding from the base plate 26 support parallel fore and aft guide rods 52, 52 (FIGS. 3–5, 7, 8) each slidably receiving two spaced bearing blocks 54, 54 of a reciprocable carriage 56 (corresponding to the Kilham et al. carriage 22). Vertical side extensions 58, 58 of the base plate 26 support a detachable bolster assembly generally designated 60 (FIGS. 3–5) for cooperation with the chill plate assembly 38, and a stationary cam roll indicator plate 62 referred to later. Conveniently to enable attachment and detachment of the bolster assembly 60 opposed spring-pressed plungers 64 (FIGS. 3–5) are receivable in bores 66 respectively formed in the extensions 58 and bores 68 (FIG. 3) of the bolster assembly; pins 69, 69 of the extensions mate with open ended slots 70, 70 of the bolster assembly, and fulcra 72, 72 formed on the bolster assembly are receivable in slots 74, 74 formed in the extensions 58, respectively.

A vertically and horizontally movable main clamp plate 76 (FIG. 3, 4, 8, 11) has a bevelled rear edge 78 nestable in aligned rearward grooves 80, 80 of a chill plate 82 of the assembly 38, and projections 84, 84 receivable in mating sockets 86 (FIG. 4) in the under side of the plate. This plate 82 is cooled by fluid, preferably at least partly water, circulated at times on demand or continuously as required from the unit 36, via the hoses 40, 42 and through tubing 88 embedded in the plate 82. The water, depending of course on the characteristics of the particular adhesive, its thickness when applied, and the nature of the particular flexible material to be stiffened as well as the selected rate of circulation, may be cooled to a thermostatically adjusted temperature in the range of about 40°–60° F. for most work and in the usual factory environment. It should be noted that as used herein the term "chill" means to bring those portions of the adhesive adjacent to the heat transfer matrix 90 promptly to a temperature below the melting point of the adhesive and thus to a condition in which they will be enabled to be rapidly separated from the matrix when the work is to be removed from the machine.

Figure 9:
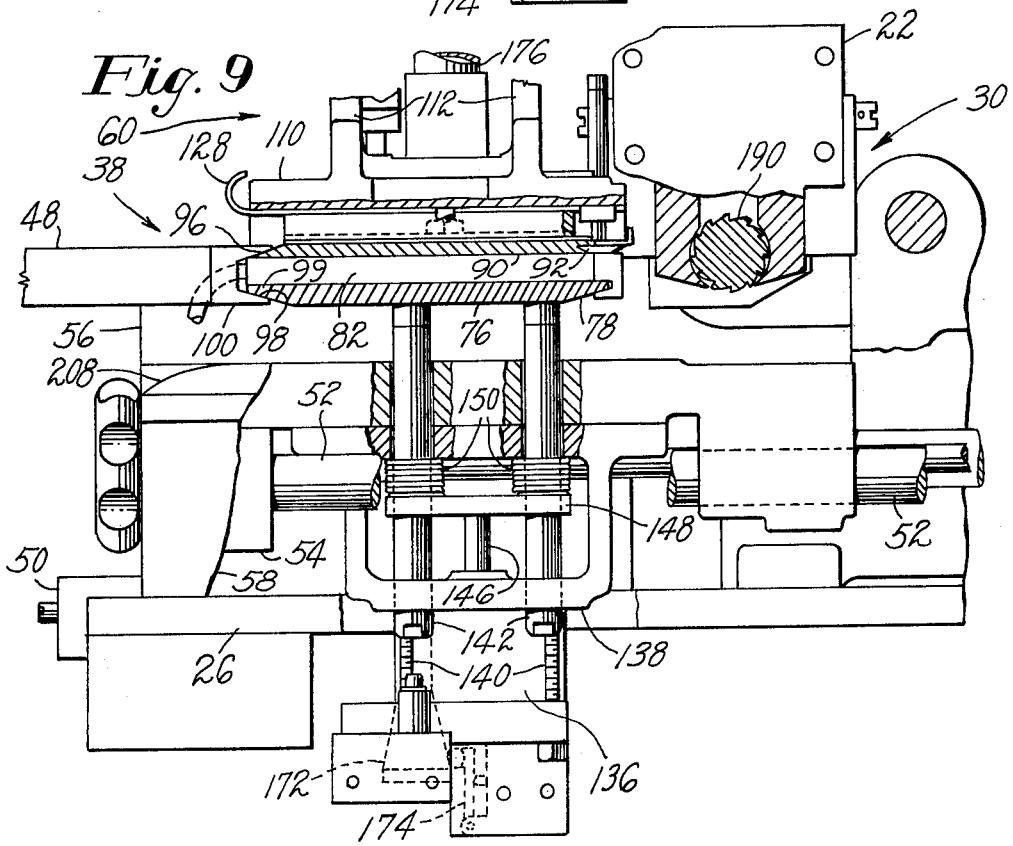
FIG. 9 is a view corresponding largely to FIG. 8, but showing the parts in their "up" or work clamping position as in FIGS. 2*c* and 6*c;*
Figure 10:
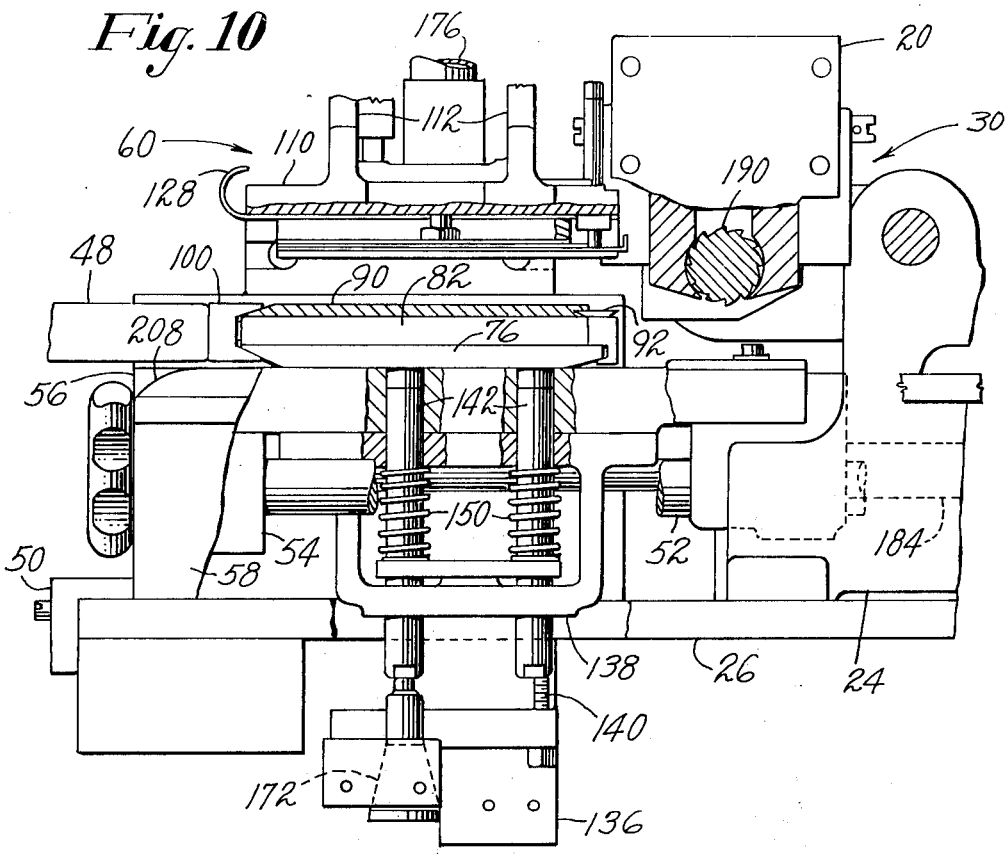
FIG. 10 is a view corresponding largely to FIG. 9 but showing the parts at a next stage wherein the work remains in its clamped upper position as in FIGS. 2*d* and 6*d* but the chill plate assembly has descended and is about to advance beneath the applicator for receiving adhesive.
Figure 11:
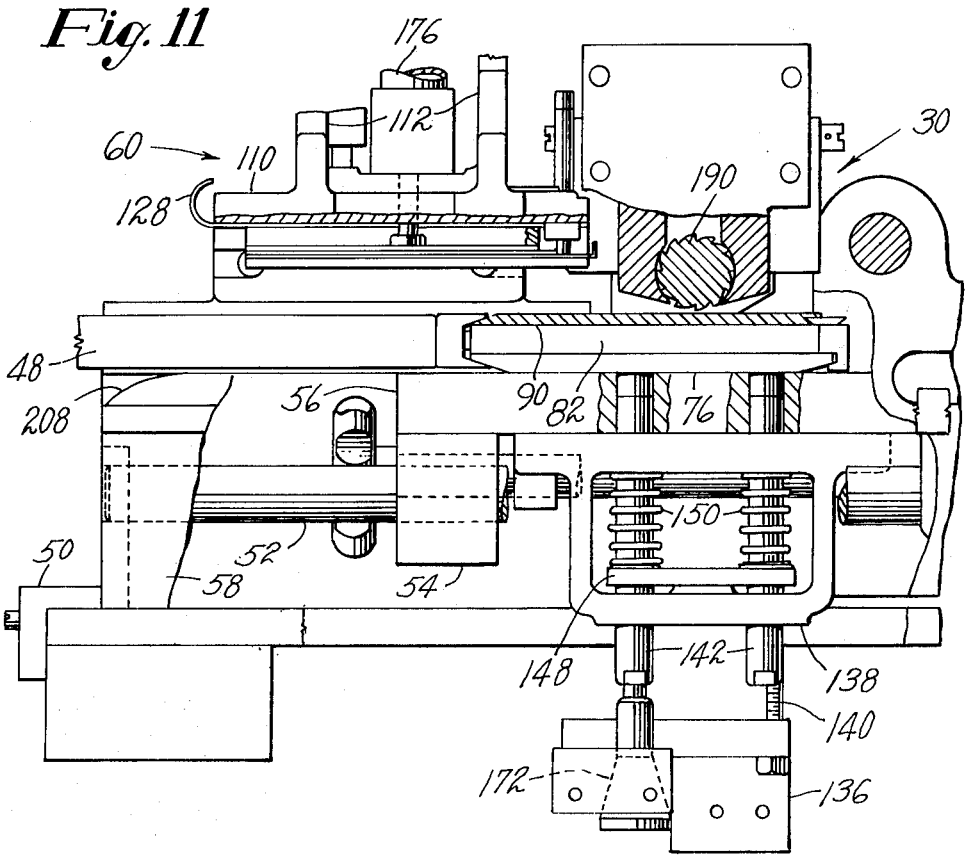
FIG. 11 is a view corresponding largely to FIGS. 10 and 2*e,* the parts being at that stage wherein a bead or ridge of molten thermoplastic is being deposited on the chill plate matrix as the latter is about to retract forwardly.
Figure 12:
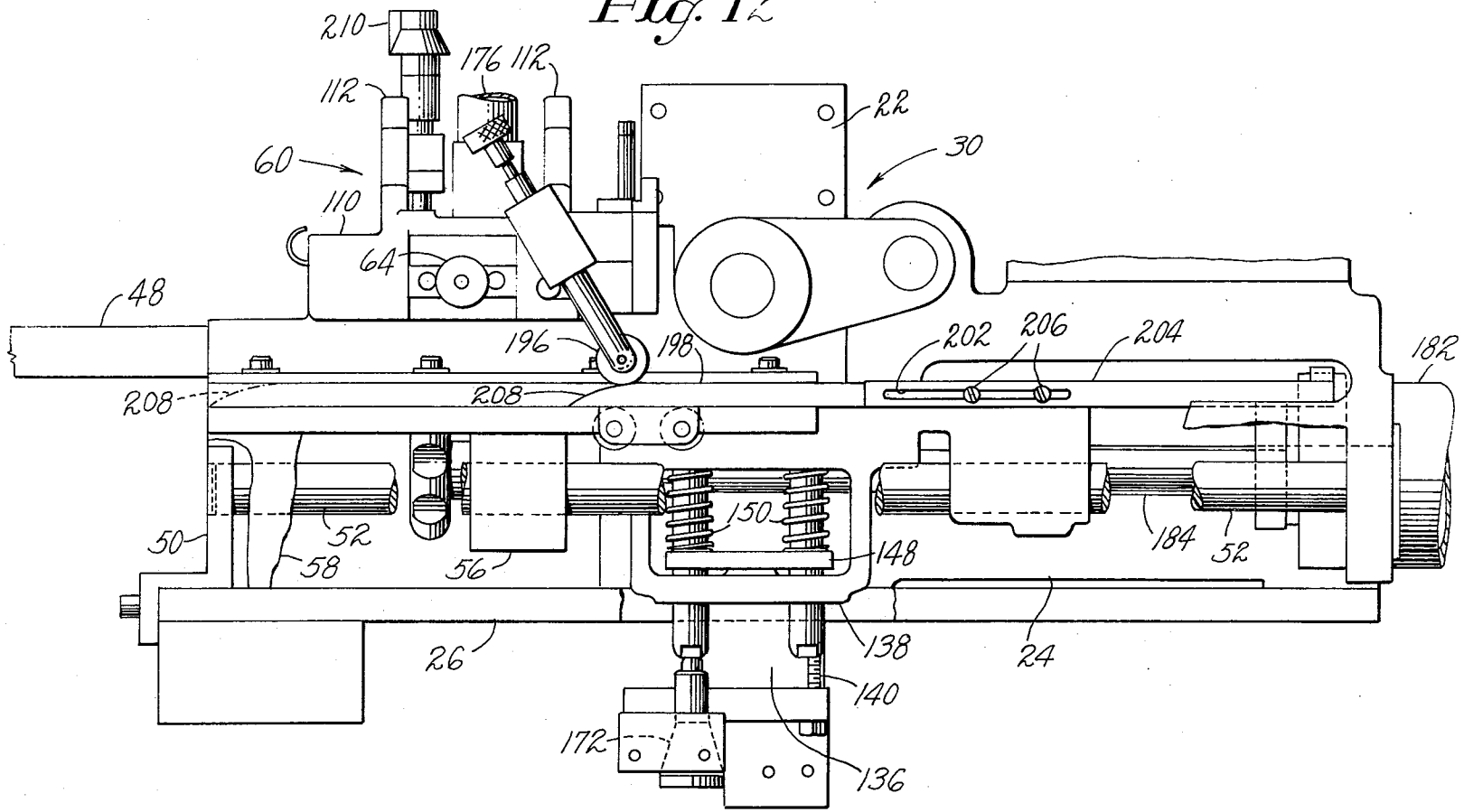
FIG. 12 corresponds largely to FIG. 11, the applicator guide cam and its adjustment means being shown for determination of desired position of the thickened adhesive ridge.

A detachable, heat conductive, and interchangeable matrix 90 having a smooth, flat configuration corresponding substantially to the predetermined area of the vamp V to be stiffened is mounted on the chill plate 82 preferably as next explained. A rear margin of the upper surface of the plate 82 has secured thereto a central conically headed positioning stop screw 92 (FIGS. 3, 13) formed to be received in a mating slot 94 in the back edge face of the matrix. For yieldably holding the head of the screw 92 and the slot 94 interlocked, a tapered front edge formation 96 of the matrix fits into the similarly shaped recess 98 (FIG. 8) in the back face of a block 100 secured to a rear flange formed on the work table portion 48. The taper of the block recess 98 also nests a tapered front edge portion 99 for securing the main clamp 76 releasably as indicated in FIG. 9. The arrangement is such that a pair of forwardly extending pins 102, 102 (FIGS. 3, 8) secured to the chill plate slidably extend through the flange of the block 100 and respectively carry springs 104, which are maintained in compression by washers and retaining screws 106 threaded onto the pins 102. It will thus be seen that, by an operator relatively retracting the table portion 48 against resistance of the springs 104 tending to hold the parts assembled, the matrix 90 may readily be disconnected from the chill plate assembly and another of desired configuration easily substituted. The arrangement also conveniently permits operator removal of the table 48 and the plate 82 as a unit.

The bolster assembly 60 is removed from the machine 18 when it is to be used for stiffening portions of even material free of perforations and/or irregularities. When the machine is employed in its new mode, i. e., for dealing with the stiffening and rendering uniform and even the irregular portions of work pieces, the bolster assembly 60 is retained for novel cooperation with the chill plate assembly 38 as will hereinafter be described. For this purpose a casting 110, to which one or more handles 112 may be secured for convenience in effecting removal or mounting of the assembly 60, has secured thereto as by screws 114, 114 a pair of guides 116, 116 having confronting slots 118, respectively, for slidably receiving edgewise the opposite lateral margins of an auxiliary clamp 120. As will become clear this clamp is to hold the work outspread, cooled and dewrinkled while adhesive material therefor is first applied to the matrix 90. In order to releasably position and retain the interchangeable auxiliary clamp 120, which has a recess 122 of configuration conforming substantially to that of the matrix then in use, leaf springs 124, 124 secured at one end to the guides 116, respectively, are yieldingly displaceable heightwise of the guide slots 118 by ball detents (not shown but seated in an upper wall of each of the slots 118) respectively nestable in bores 126 (one only shown in FIG. 3) formed in the auxiliary clamp 120.

In a manner similar to that just described a bolster plate 128 (FIGS. 2–5, 8) having a resilient pad 130 bonded to its underside is removably mounted in the casting 110. Thus slotted spaced guides 132 affixed to the casting are adapted slidably to receive lateral margins of the plate 128 until bores 134 in the latter seat ball detents (not shown) in the slots.

Mechanism for vertically reciprocating the chill plate and main clamp assembly 38 will now be described having particular reference to FIGS. 3–5, 7–12. An air cylinder 136 is secured beneath a U-shaped member 138 as by bolts 140, the upper ends of which are threaded into the cross bar portion of the member 138. The main clamping plate 76 is carried by the upper ends of four vertical guide rods 42 which slidably extend through vertically aligned pairs of bores formed in the member 138. A piston 144 (FIGS. 4 & 5) in the cylinder 136 has its piston rod 146 connected to a plate 148 bored to slidably receive the rods 142, respectively. Compression springs 150 on the rods 142 above the plate 148 are confined by the member 138 to urge the clamping plate 76 to return to its down position after elevating fluid pressure, admitted into the cylinder 136 beneath the piston upon actuation of suitable valving, has been relieved.

It will be understood from the foregoing that the arrangement is such that after the operator has moved the work piece V over the table 48 and onto the matrix 90 as shown in FIGS. **2*b* and 6*a* in readiness for being flattened out and held clamped, he may depress a valve-controlling treadle 152 (FIGS. 1 & 14) to the first of its two-stage control levels to cause the chill plate and main clamp assembly 38 to rise, carrying up with it the auxiliary clamp 120, thus to clamp the work against the under surface of the bolster pad 130 (as shown in FIGS. 2*c*, 5, 6*b* and 6*c*). Incidentally, prior to thus actuating the treadle, the work piece V was properly positioned prior to being clamped by being located edgewise against vertical plunger pins 154, 154 which are laterally adjustable to accommodate differently shaped work pieces. For this purpose lower ends of the pins 154 are each engageable endwise with the upper surface of the auxiliary clamp 120 as shown in FIGS. 2*a*, 2*b* and are carried in sleeves 156 secured, respectively, to toggle links 158, 158. Accordingly, the knee of the toggle is shiftable forwardly and rearwardly by a pivot pin 160 connecting the links to a slide 162 manually reciprocable in a kerf 164 in the casting 110. For holding the pins 154 in selected working position a clamping thumbscrew 166 extending through a slot 168 in the slide has a lower end threaded into the casting. It should be noted, too, that rear grooves 170, 170 (FIG. 3) in the bolster plate 128 are adapted to receive the sleeves 156** to insure correct bolster plate positioning.

Figure 5:
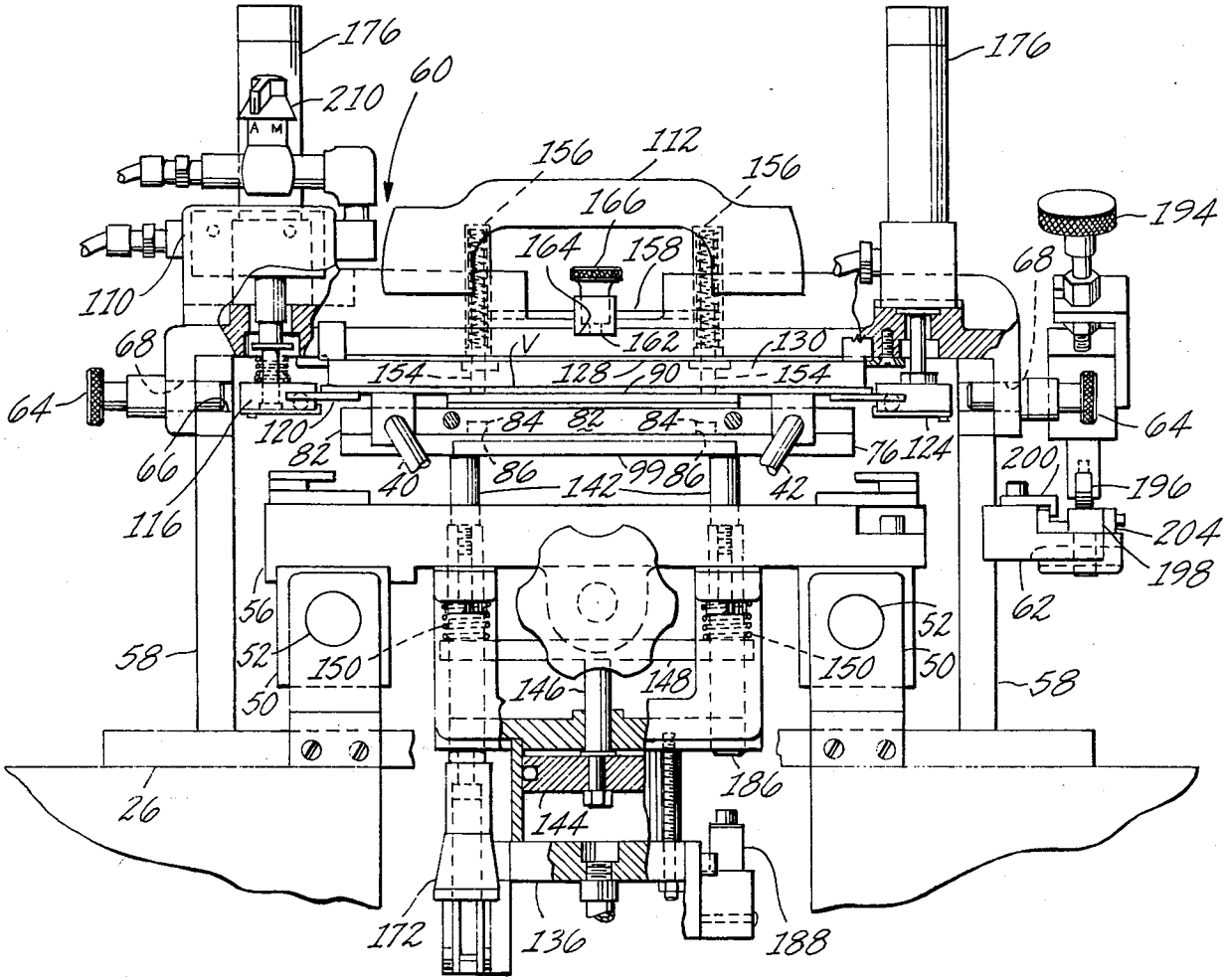
FIG. 5 is a view corresponding to FIG. 4 but with the parts now shifted to their "up" or work-clamping position, as in FIG. 2*c;*
Figure 6:
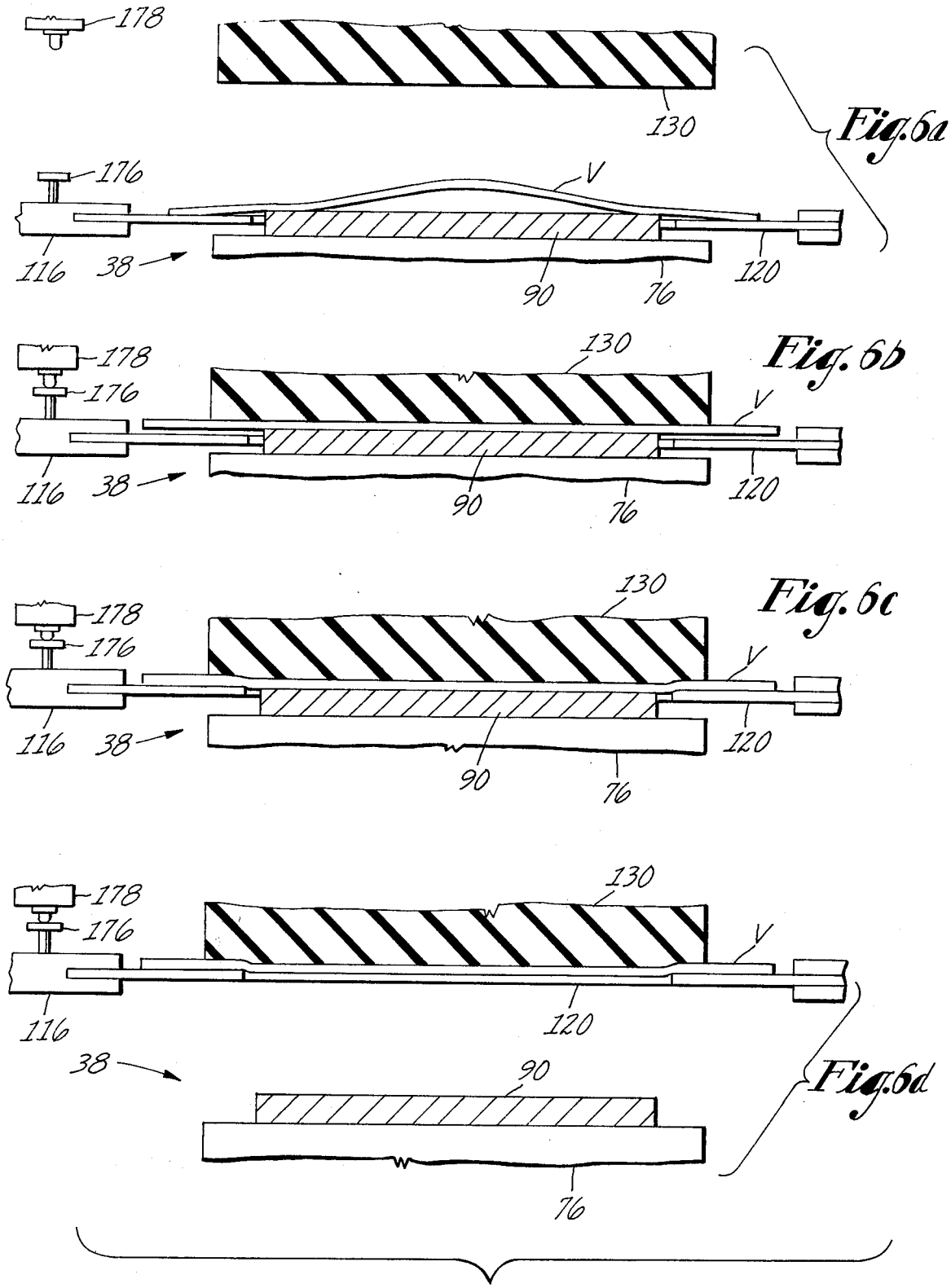
FIGS. 6*a* through 6*d* are transverse sections diagrammatically showing the sequential steps taken by the main and auxiliary clamping means indicated in FIGS. 4 and 5 to prepare a work piece for subsequent reception of adhesive.
Figure 7:
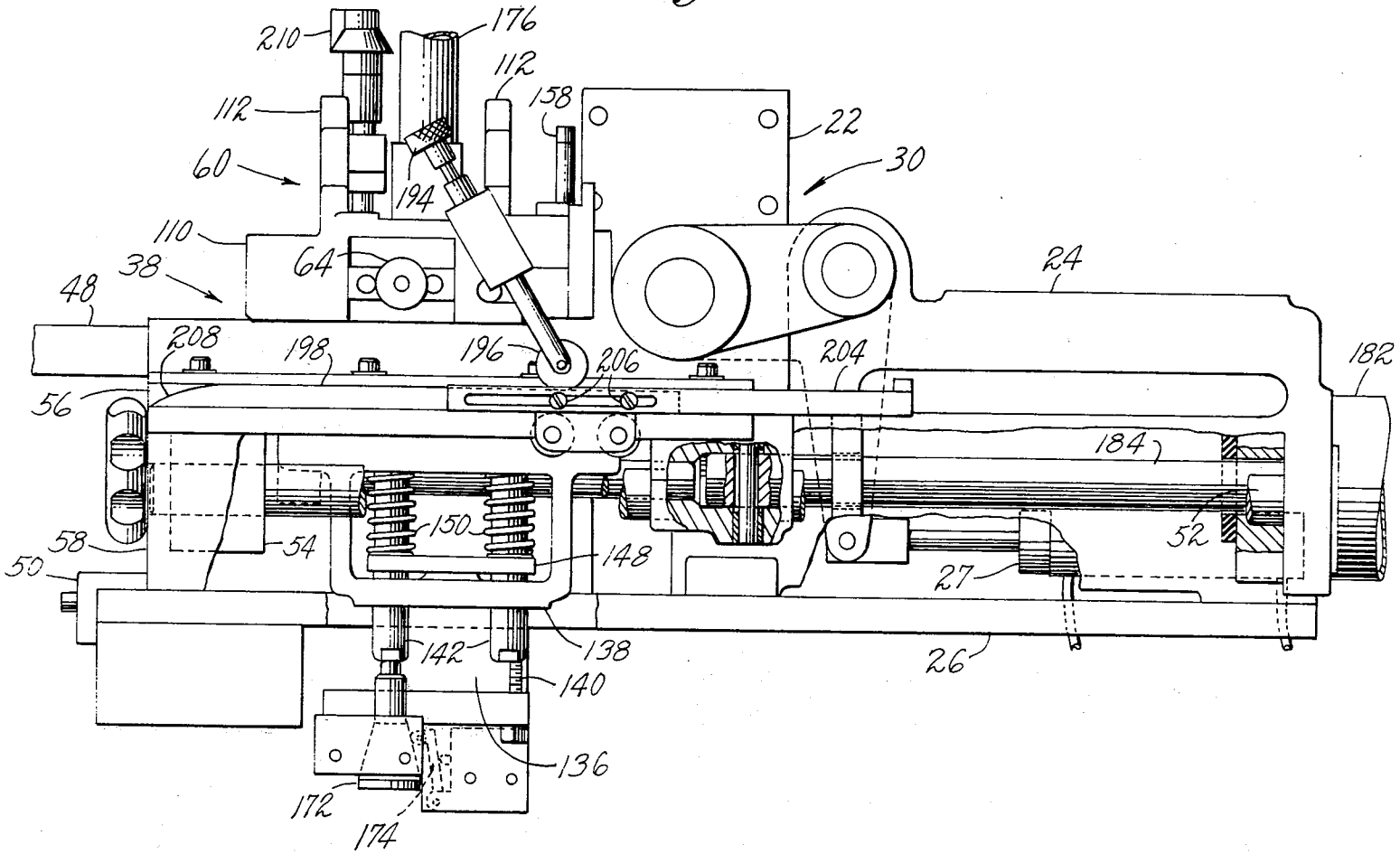
FIG. 7 is a view in side elevation of the head shown in FIG. 4 and mechanism for actuating the head in translation, the work table being in the start position as in FIG. 2*a,* and adjustable cam means for controlling the applicator assembly being indicated.
Figure 8:
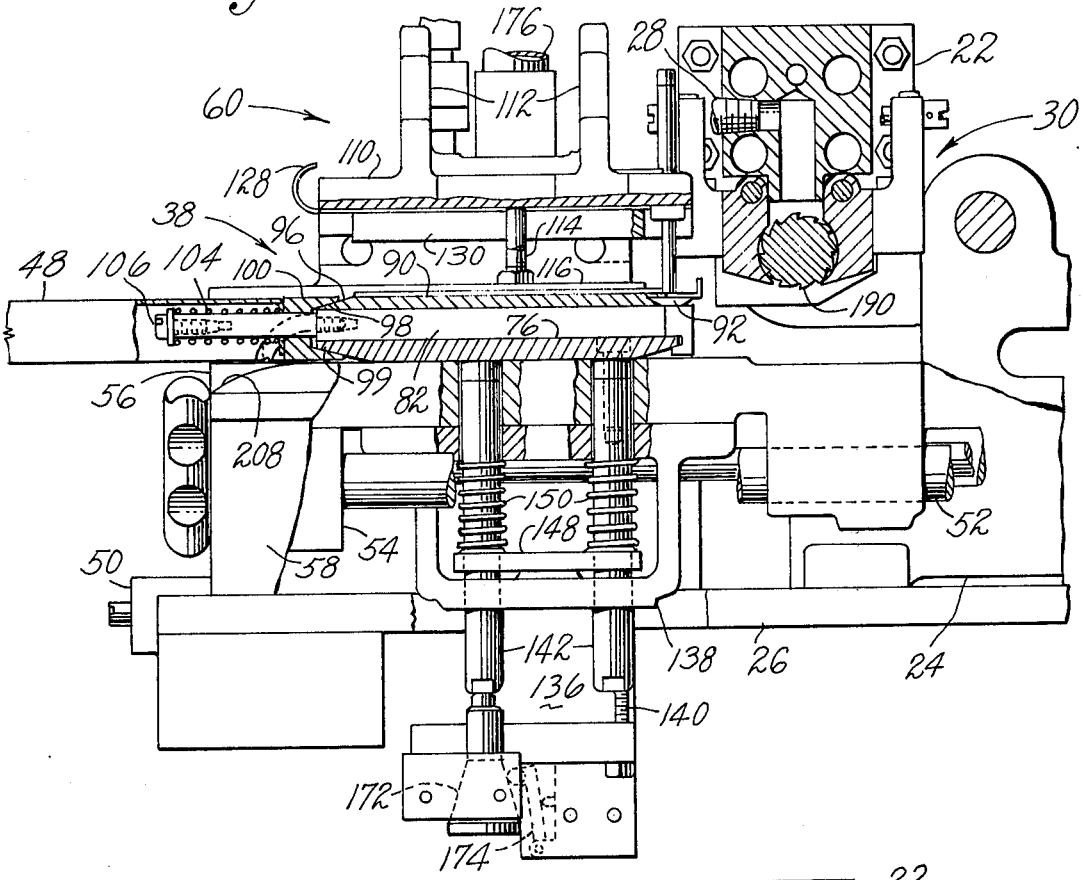
FIG. 8 is a view largely corresponding to FIG. 7, but with portions broken away to reveal structure.

In the course of this preliminary clamping up and cooling of the vamp V by the chill plate matrix 90 acting against the bolster pad 130 (as shown in FIGS. 5 and **6*b*), unwanted wrinkles and depressions and eliminated as the work is flattened. Then the raising by the main clamp of the auxiliary clamp 120 with its guides 116 effects preliminary light clamping of the outspread lasting margin of the vamp against the bolster pad 130 as shown in FIG. 6*c*. For heavier pressure to this end, a tapered cam 172 (FIGS. 4 to 6) secured on one of the guide rods 142 is arranged to thereupon actuate a switch 174 triggering admission of fluid into spring-return piston-cylinder devices 176, 176 (FIGS. 3–5) mounted on the casting 110 causing lifting of the plate 120** and the work to be held firmly clamped by the margin, all as indicated in FIG. *2d.* Having been pressed flat by joint action of the interfitting matrix 90 and the clamp 120, and a dwell may be provided if desired, a spring plunger 176 secured on one of the guides 116 actuates a switch 178 (FIG. 3) exhausting fluid pressure from the cylinder 136 and permitting downward return movement of the chill plate matrix assembly 38 as shown in FIG. *6d.* In the event the operator is not satisfied with the way in which the work is clamped, he may release the partly depressed treadle switch 152 and actuate a reset valve releasing the work for repositioning. If he finds the work positioning satisfactory, he further depresses the treadle 152 to its second stage position thereby signalling for completion of the machine cycle as will next be described.

The carriage 56 then moves the chill plate assembly 38 in translation rearwardly as shown in FIG. *2e* upon actuation of a dual acting piston-cylinder device 182 (FIGS. 7, 8, 11, 12), corresponding essentially in structure and operation to the cylinder 36, etc., of the Kilham et al. patent referred to above, an adjustable limit step determines the limit of carriage travel. A piston rod 184 of the device is connected to the rear end of the carriage and accordingly is effective to position the chilled plate matrix 90, as shown in FIG. *2e,* in adhesive deposit receiving relation to the applicator device 30. To insure that the carriage 56 cannot move in translation until it has fully descended, a contact 186 (FIG. 5) must downwardly displace the actuator of a switch 188 mounted on the cylinder 136. The switch 188 may also be employed for a further function, namely to start circulation of the cooling medium from the unit 36 in the event it had not been set for continuous operation and circulation.

In the new mode of operation, in the cycle being described the adhesive deposit is progressively made as the matrix is in its inner dwell position and as it is returned relatively forwardly with respect to a rotating applicator roll 190 (FIGS. 8–11) of the device 30. Since, as in the Kilham et al. disclosure, the roll 190 is ineffective to leave any deposit until the roll is lowered to near-contact with the surface of the work or of the matrix 90, as the case may be, the motor 27 acts through a bell crank thus to lower the device 30 in response to the matrix 90 reaching the inner end of its inward stroke. An important feature now to be explained is the means provided for causing the device 30 to deposit a molten marginal bead or ridge of adhesive as shown at 192 in FIGS. *2f,* 13, *13a* and 14, which ridge is thicker than the substantially uniform, adjacent remainder of the thermoplastic coating C thereafter applied to the matrix and hence slower cooling. The characteristic that the molten ridge 192, being thicker, retains heat for a longer time and therefore is less viscous than the coating C is used advantageously, as will be described shortly, to effect an improved transfer enlarged as well as different and shaping of the adhesive about to be overlaid or printed on the outspread underside of the work piece V. Hitherto the Kilham et al. applicator arrangement had been designed to produce a "skive" or "feather" at the work piece leading edge where adhesive is applied; now, in contrast, the applicator assembly 30 produces the largely molten ridge 192 by relatively dwelling, at about the limit of translation of the carriage, above the leading heelward margin of that area of the matrix 90. Usually the ridge 192 is automatically limited in width by relatively lowering the assembly 30 as matrix retraction is effective following its dwell. For this purpose, and for suitably locating the ridge 192 lengthwise of the matrix (and hence also with respect to the work V) for particular work pieces, the frame 24 on one side supports a spring-loaded plunger 194 (FIGS. 1, 3–5, 7–9) adjustably carrying a cam follower roll 196 arranged to cooperate with the upper surface of a reciprocable cam 198 (corresponding to the cam block 86 in the Kilham et al. patent). The cam 198 (FIG. 3) is retained for sliding along a shoulder of the cam indicator plate 62 by an angle bar 200 (FIG. 3) secured to the plate 62. A horizontal slot 202 in a bar 204 is adjustably secured by thumb screws 206 threaded into the outer side of the cam 198 for travel therewith. The cam 198 has an inclined forward end portion 208 (FIGS. 3, 7–12) which may be thus selectively located such that it will, when the carriage 56 is about to reverse from its position indicated in FIG. 12 and retract the chill plate matrix 90 to its forward position shown in FIG. 1, cause the follower roll 196 to rise on the portion 208 thereby causing (through mechanism corresponding to that in the Kilham et al. disclosure) the applicator device 30 to be lowered toward the matrix until the flat of the cam 198 terminates the ridge and controls the substantially uniform thickness of the thinner coating C. Other means is also provided incidentally, though not important for present purposes, for varying the rate at which adhesive may be deposited. This progressive action is diagrammatically indicated in FIG. 14 for the new cycle, the thermoplastic formation 192 and C being shown in side elevation. As indicated by FIG. *13a,* when a wider ridge 192 (considered lengthwise of the vamp V) is desired, the cam 198 may be set so that the roll 196 rides only on the flat surface of the cam 198 and not on the portion 208, the inherent dwell period for the carriage 56 then determining the wider size of the ridge 192.

When or as the matrix and main clamp assembly 38 arrives at its outer position, a pair of hand trip valves 200, 200 (FIGS. 1, 14) is actuated to again cause this assembly to be raised by the piston 144 for cooperation with the bolster assembly 60 in transferring the coating C and the material of the ridge 192 from the chill plate 90 to the marginally supported, outspread and registered work as indicated in FIGS. *2g* and 13. At this stage the controls automatically effect a variable, preselected time delay to enable the main clamp plate 76 to cause the chilled matrix suitably to dwell while applying pressure for fully transferring the adhesive. It is important to note that the matrix is brought upwardly as from its lower position in FIG. 13 and against the work clamping resilient pad 130 preferably with some suddenness and impact. This is to cause the still molten material of the ridge 192 to be exuded laterally from the adjacent more viscous material of the transferred coating C. As herein shown, there is no place for the compressed ridge material to go except away from the toe end of the vamp. Accordingly, not only is the ridge reduced in thickness as it flows from the coating C, but it is forced to spread laterally beyond the original outline of the deposit and into the form of a tapered margin designated M in FIG. 13. This margin of course rapidly hardens as it is more thinly formed, and it also becomes less stiff toward the edge where it merges with the undersurface of the vamp V.

At the conclusion of the cooling dwell, air in the cylinder 136 is exhausted to permit return descent of the main clamp and matrix assembly 38 by influence of the springs 150. Such separation of the matrix 90 is effected prior to release of the auxiliary clamp 120 to exert breaking tension on any adhesive bonds which the matrix may still have with the thermoplastic transferred to the work; occasionally, for instance, if the upper surface of the matrix had become inadvertently roughened or affected by extraneous adhering matter, it is desirable that such bonds be thus severed. Next the auxiliary clamp 120 is lowered by release of fluid pressure from the piston-cylinder devices 176, 176 and, as indicated in FIG. *2h,* the stiffened work piece V may be unloaded from the machine prior to starting a new cycle.

It should be observed that when an operator is experienced and familiar with the machine, he or she need not use the treadle 152 in two stages, but may depress it directly to its lower level to effect operation in a continuous cycle. Incorporation of the dual hand control valve switches 200 is for the purpose of insuring that an operator's hands are not then exposed to danger from contact with moving parts or molten adhesive, but it will be apparent that, where permissible, these could be omitted from the control system to shorten the cycle or minimize operator attention, incorporating other safety measures if deemed necessary.

Figure 14:
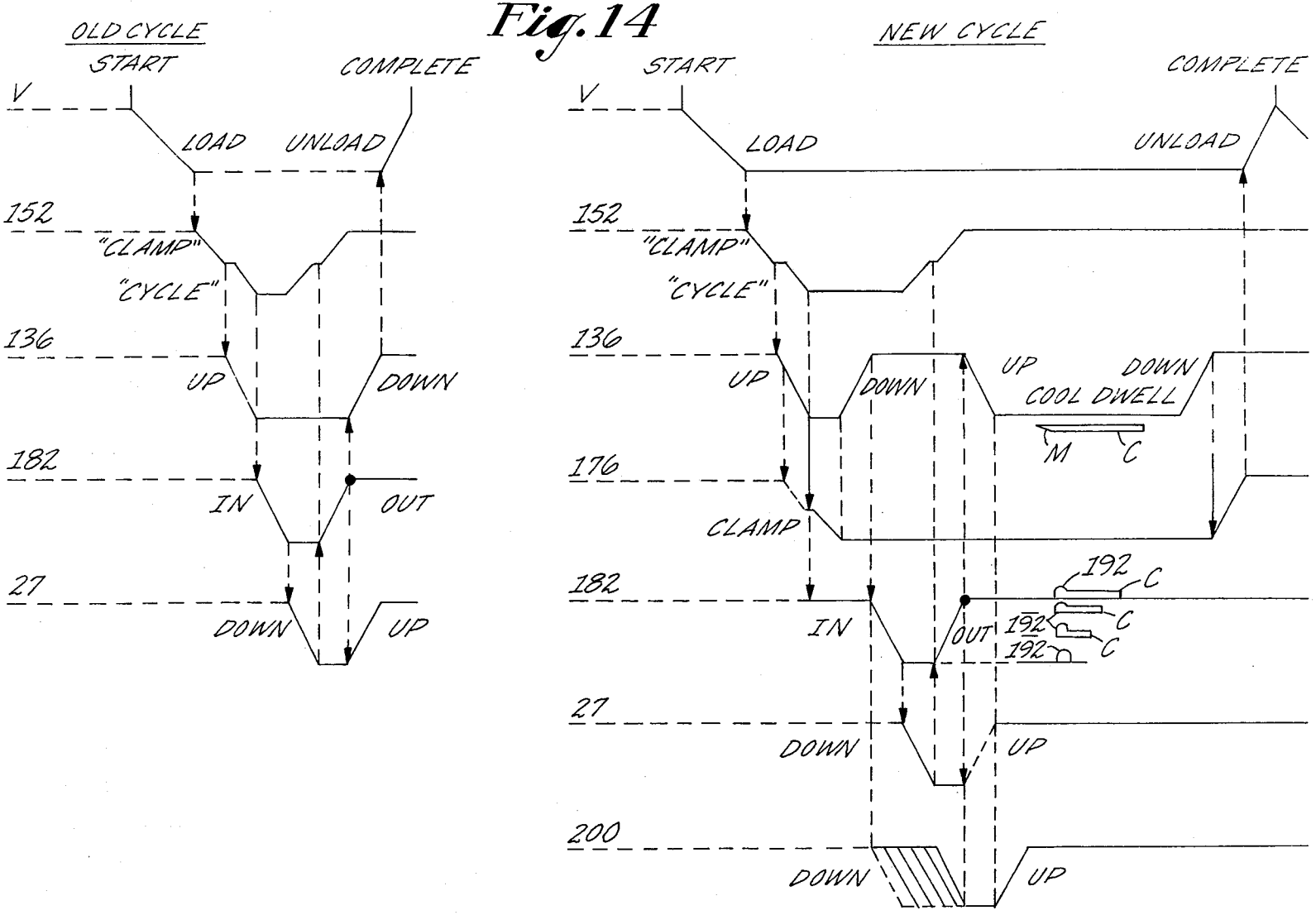
FIG. 14 is a timing chart comparing the sequence of operations of the machine in its alternative modes.

Operation of the machine 189 in its alternative new mode will now be briefly reviewed, reference being had when desired to FIG. 14 for comparison with the old mode wherein the thermoplastic was initially applied directly to the work piece V instead of to the matrix 90. Assuming the control system has been appropriately adjusted for the particular thermoplastic and work V to be combined, that suitable matrix shape and auxiliary clamp 120 are selected and mounted, and that positioning pins 154, 154 have been located as desired, the operator slides the work over the table 48 to engage those pins, the bolster assembly 60 now being secured in operating position by means of the plungers 64. Next, he either fully depresses the treadle 152 for a full cycle to the point where the safety trip valves 200 must be manually actuated, or he partly depresses the treadle to cause the work to be pressed flat against the bolster pad 130 first by the energizing of the cylinder 136 and the uncoated matrix 90, and then by the auxiliary clamp 120, when its cylinders 176 are pressurized, to clamp the vamp by its lasting margin and in outspread condition. Unwanted pockets or wrinkles are thus prevented from being subsequently, in effect, molded into the stiffened work piece. Being satisfied as to inspection of the work as thus flattened and registered, he fully depresses the treadle to pressurize the cylinder 136 and allow descent of the main clamp assembly 38, the outspread lasting margin now being held in its registered position by the clamp 120 only. In this condition the exposed under surface of a portion of the vamp V will subsequently receive molten adhesive by transfer from the matrix 90. When lowered, the matrix is clear for movement inwardly in translation to accept molten adhesive from the applicator 30, the contact of the button 186 with the switch 188 signalling the cylinder-piston 182, 184 for such action.

Figure 13:
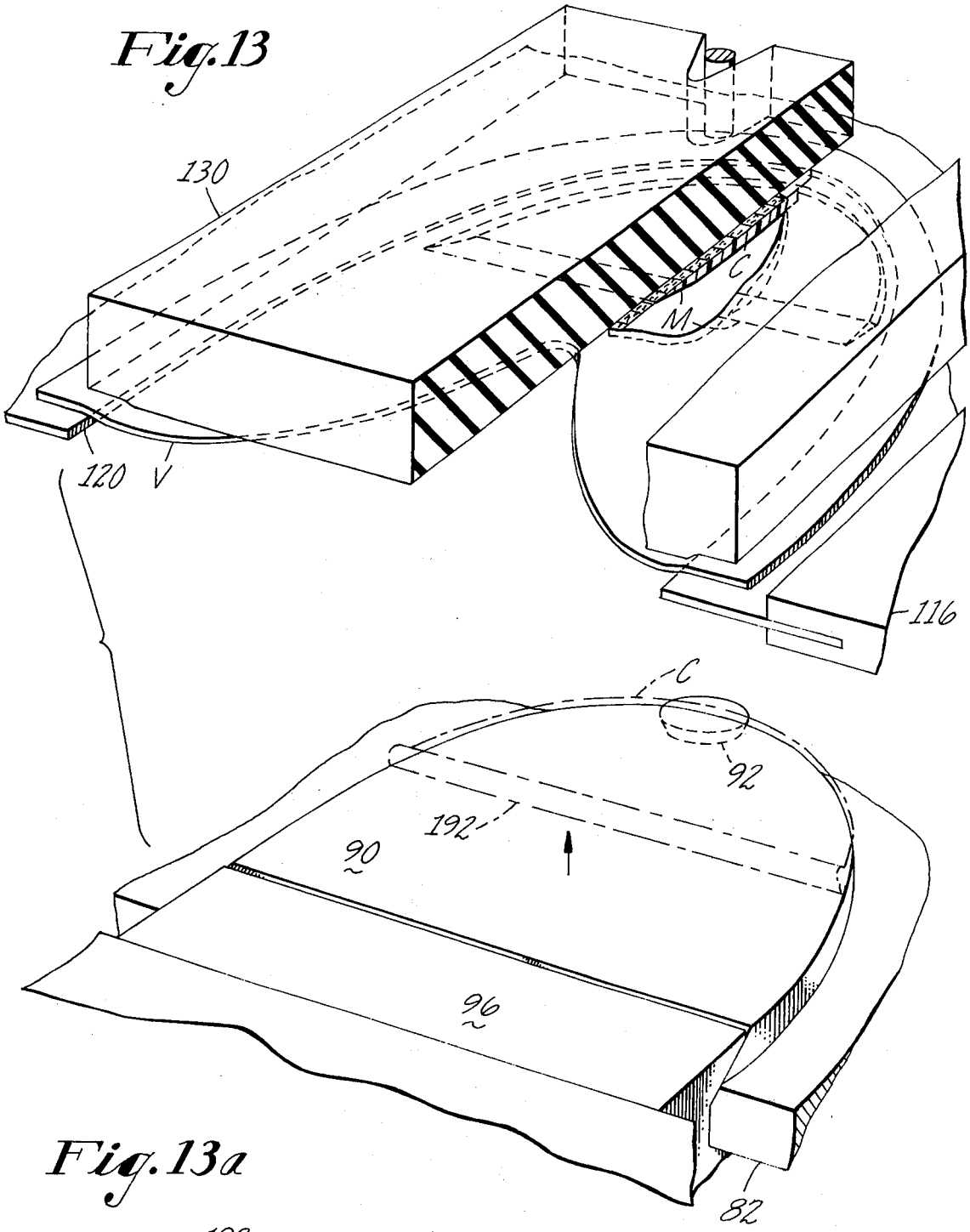
FIG. 13 is an enlarged perspective view of the retracted matrix with adhesive ridge and coating registered beneath the clamped work, the position of the adhesive when transferred to the work being shown by dash lines.
Figure 13A:
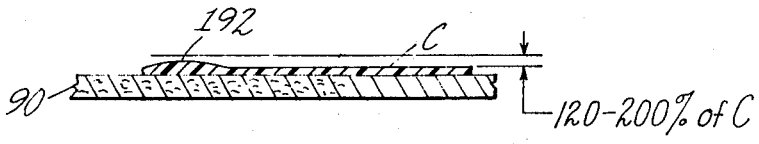
FIG. 13*a* is a section of an adhesive ridge and coating as deposited when only dwell of the matrix and a flat control cam are employed.

Arrival of the matrix 90 nearly at its rearmost or innermost position actuates a switch, as in the Kilham arrangement referred to, for pressurizing the dual acting motor 27 (FIG. 7) whereby the applicator roll 190 is lowered to allow adhesive to be applied to the matrix. The cam portion 208, if it is to limit width of the ridge 192 deposited during carriage dwell, will have been adjusted to cause the roll 190 to be lowered toward the matrix thus continuing deposit but locating the thinner coating C at the desired position following formation of the ridge 192. While the carriage travel is being reversed, the matrix is in a temporary translatory dwell which causes dispensing of the conrolled extra adhesive thickness of the ridge 192. Next, as the matrix is withdrawn toward its outer position, the follower roll 196 progresses to the higher flat upper surface of the cam 198, thus allowing the applicator roll 190 to descend and limit the ridge width and to deposit the adjacent thinner coat C. If the follower roll 196 does not engage the portion 208 of the cam, the wider ridge 192 of FIG. 13*a* is formed. Upon separation of the matrix from the roll 190 the latter is raised by the motor to a non-dispensing position.

During the return movement of the carriage 56 to return the matrix to its outer postion, the operator actuates the hand trip valve 200, 200. This causes fluid pressure to drive the piston 144, and hence the main clamp plate 76 and the chill plate 82 with the adhesively coated matrix, upwardly against the cooperating bolster assembly 60. Accordingly, as indicated in FIG. 13, the matrix 90 is pressed firmly against the under surface of the vamp V exposed and held flat by the auxiliary clamp 120. Material of the ridge 192, being slower cooling and hence less viscous than that of the thinner coating C being transferred from the chilled upper surface of the matrix, is then more fluid though upper portions of both the ridge 192 and the contiguous coating C are still molten. The pressure exerted by the matrix with some impact against the vamp portion to be stiffened is countered by the resilient pad 130 as indicated in FIGS. *2g* and 13. The coating C is pressed against and transferred to the more toe-ward portion of the exposed vamp V, and the largely confined ridge 192, as the result of the pressure and impact, is exuded laterally away from the toe-ward end, i.e., toward the front of the machine 18. It will be apparent that there is no other place for the otherwise enclosed ridge material 192 to spread as it is compressed between the top flat surfaces of the matrix and the under flat surface of the pad 130. The ridge material is consequently formed into a tapering margin M diminishing in stiffness to the edge where it merges with the undersurface of the vamp V. This feature is important both in avoiding an unattractive deformation in the shoe upper at the instep region, and in assuring greater comfort in wearing of the finished shoe.

After expiry of a selected dwell wherein the now thinner ridge material more rapidly hardens, the matrix 90 is first released from its work pressing relation by air pressure in the cylinder 136 being exhausted and the springs 150 becoming deenergized. Thus the adhesive bonds, if any, between the matrix and the still marginally clamped vamp V are broken by tension, whereupon the piston-cylinder devices 176 are deenergized to separate the auxiliary clamp 120 for gravity release of the stiffened work piece as indicated in FIG. *2h.*

When the machine 18 is to be converted from operation in the new mode above described to perform stiffening of regular, uniformly shaped work pieces according to the prior mode of operation indicated in FIG. 14, a few steps and precautions are in order by the machine operator, but no machine or other specialist is normally required. A clamp selector switch 210 (FIG. 1) on the bolster casting 110 should be turned to its manual position. When next the treadle 152 is depressed to close the auxiliary clamp 120 by actuation of the devices 176, the bolster assembly 60 may be disconnected (except for tubing) as above described from the side extensions 58 and placed in an out-of-the-way position, for instance on brackets (not shown) attached to the side of the housing 44. Conveniently the chill plate and matrix assembly 38 along with the hoses 40, 42 may be stored as a unit under the top of the table 32 or along the side of the unit 36 without disconnection of the hoses; relative retractive forward movement of the main clamp 76 by the operator dislodges its tapered edge 78 from the chill plate grooves 80, allowing the operator to shift the table 48 along with the assembled parts 82, 90 and 100. After actuating the clamp reset switch 210 and moving a work selector switch 212 (FIG. 1) to "plain", the operator installs a stationary clamp (not shown) and mounts a flat rubber matrix (not shown) on the plate 76. The "plain", i.e. not irregular surfaced work, may then be processed according to the old mode.

It will be apparent from the foregoing that the invention provides a versatile machine capable of handling both regular and irregular work pieces to be stiffened by adhesive, and that the stiffening effect may be diminished in a selected margin when the thermoplastic is transferred by the printing on method herein described.

Having thus described our invention, what we claim as new and desire to secure by Letters Patent of the United States is:

1. A machine for stiffening a predetermined portion of a flexible work piece comprising, in combination, means for supporting the work piece with said predetermined portion exposed and outspread, a matrix or plate having a surface corresponding to that of the portion to be stiffened and adapted to be chilled, the plate and the support means being relatively movable into and out of register, means for depositing molten thermoplastic material on the chilled plate surface with a marginal ridge of the material thicker and hence slower cooling and less viscous than the remainder of the deposit, and mechanism for relatively moving the plate and the work supporting means into registered pressing relation to combine the deposited material with said exposed portion of the work piece while the material is still molten and simultaneously cause the thicker, less viscous marginal ridge of the material to be laterally exuded beyond the outline of the original thermoplastic deposit and transferred with tapering thickness to the workpiece.

2. A machine as in claim 1 wherein the means for depositing the thermoplastic material comprises an adhesive applicator device relatively movable in translation with respect to the plate, and mechanism for changing the operating level of the device relative to the chill surface near a limit of the translation to limit the extent lengthwise of the initially thicker ridge of thermoplastic adjoining anotherwise substantially uniform thickness of thermoplastic coating.

3. A machine as in claim 2 wherein said mechanism for changing the operating level of the applicator device includes a guide cam, and means for adjusting the position of the guide cam to predeterminedly reduce the width of the thicker thermoplastic ridge and hence locate the subsequent tapered margin of thermoplastic formed therefrom lengthwise of the work piece.

4. In a machine for stiffening a portion of a flexible work piece, the combination with means for dispensing molten thermoplastic adhesive, of a bolster assembly, a movable chill plate and main clamp assembly including a matrix engageable with said portion, said bolster assembly including an auxiliary clamp arranged to be moved by the main clamp assembly to hold said portion of the work piece flat and outspread against a resilient portion of the bolster assembly, mechanism operable while the work is thus held for causing the chill plate and matrix main clamp assembly and said dispensing means to be cooperatively moved in relative translation for depositing molten adhesive including a thicker ridge thereof on a predetermined portion of the matrix of said main clamp assembly, and other mechanism for then registering the main clamp assembly with its matrix in pressing relation with said outspread work piece portion to transfer the deposited adhesive while still molten thereto in such manner that the less viscous adhesive of said ridge is compressed and caused to flow outwardly and in contact with the work beyond the outline of the initial deposit.

5. A machine as in claim 4 wherein the bolster assembly comprises in superposed relation a resilient bolster pad and said auxiliary clamp, the latter being interchangeably mounted in the bolster assembly and having a recess configuration conforming substantially to a perimeter of the matrix of said chill plate and matrix main clamp assembly.

6. A machine as in claim 4 wherein said other mechanism includes a control means for causing the main clamp to dwell for a predetermined interval in said pressing relation and then effect separation of the matrix from said work piece portion normally and prior to release thereof by said auxiliary clamp.

7. A machine as in claim 4 comprising a refrigerator and pump unit for circulating cooling fluid to and from said chill plate and matrix main clamp assembly, and control means responsive to relative separtion of the main clamp assembly from the bolster assembly initially in a cycle for commencing the circulation of said fluid to and from said matrix.

8. A machine as in claim 4 wherein adjustable means is provided for predeterminedly positioning the work piece relative to the auxiliary clamp prior to pressing engagement of the main clamp assembly with the work piece.

9. A machine as in claim 4 and further characterized in that actuator means is mounted on the bolster assembly for causing the auxiliary clamp to firmly engage the work piece margin in response to arrival of the matrix main clamp assembly into work pressing relation.

10. A machine of the type set forth in claim 4 wherein the chill plate and matrix main clamp assembly comprises a plate for receiving circulatory cooling fluid, an interchangeable matrix detachably mounted on said receiving plate, a table over which the work may be moved for placement on the matrix, and a locking means interposed between the table and said receiving plate for yieldably holding the matrix detachably secured on the plate.

11. A machine as in claim 10 wherein said locking means includes a tapered groove for receiving correspondingly shaped portions of the matrix, and of the chill plate, respectively, and a spring means for urging said portions of the matrix and of the plate yieldingly to mate with the groove.

12. A machine as in cliam 4 wherein said other mechanism is also employed to move the matrix of the main clamp assembly into work flattening relation prior to effective operation of the auxiliary clamp against the work.

13. A machine as in claim 4 wherein, in response to arrival and dwell of the main clamp assembly at termination of its translation in one direction, mechanism is operative to cause said dispensing means to deposit on the matrix a ridge of molten thermoplastic of thickness 120–200 percent greater than an adjacent relatively uniform coating applied by the dispensing means.

14. A machine as in claim 13 and further comprising means for adjustably determining the location, lengthwise of the matrix, of the thermoplastic ridge.

15. A machine for stiffening predetermined portions of footwear components or the like, and operable in alternative modes dependent upon whether the component portions having regular or irregular surface, said machine comprising means for releasably supporting a component outspread, means for applying molten thermoplastic to a deposit area with uniform thickness or with such thickness and a contiguous thicker ridge, a carriage adaptable for moving the component itself or a detachable printing-on matrix of chillable metal into and out of position for receiving thermoplastic coating from the applying means, and mechanism thereafter operable, when the matrix is employed, to move the thermoplastic-bearing matrix abruptly against a component held by said supporting means to transfer the coating from the matrix to the irregular work piece portion and spread said ridge material beyond the outline of said deposit area.

16. In a stiffening or box toe applying machine of the type including in spaced relation a bolster assembly and an applicator means for depositing molten thermoplastic adhesive, a movable carriage, a chill plate main clamp assembly with detachable matrix mounted on the carriage, and mechanism for sequentially moving the carriage in translation and heightwise first to cause the matrix to register a work piece on the bolster assembly, next to cause the matrix to receive a molten thermoplastic deposit from the applicator means, and then to transfer the deposit while an exposed surface thereof is still molten from the matrix to the registered work piece, the matrix being held during said transfer in a pressing relation dwell with respect to said bolster assembly to exude less viscous portions of the deposit outwardly onto the registered work.

17. For use with a machine for stiffening portions of flexible work pieces and of the type having an applicator for depositing molten thermoplastic, and a carriage relatively movable in translation with respect to the applicator to receive deposited thermoplastic, a bolster assembly secured in register with the carriage when it is remote from the applicator, a chill plate matrix assembly detachably mountable on the carriage, said carriage in its remote position being automatically and relatively movable heightwise with respect to the bolster assembly to carry the matrix assembly with adhesive deposited on a predetermined area thereof and into and out of pressing relation with a work piece portion on the bolster assembly whereby the adhesive is spread beyond said area, and power means for cyclically moving the carriage in either of two modes respectively involving only translation or translation and relative heightwise movement.

18. In a machine for stiffening portions of flexible work pieces and of the type including a movable chill plate adapted to be cooled by a circulating fluid therein, a bolster assembly, a molten thermoplastic applicator, reciprocable power means including a main clamp for sequentially moving the chill plate into and out of cooperative work holding relation with the bolster assembly and the applicator, and means for detachably mounting a thermoplastic-receiving matrix on one side of the chill plate and the clamp on the opposite side thereof, said power means being automatically operable in a cycle of the machine to force a lesser viscous portion of the thermoplastic deposited by the applicator on the matrix to be spread outwardly thereof as said viscous portion is transferred from the matrix to the work being held by the bolster assembly.

19. A machine as in claim 19 wherein both the main clamp and the matrix are formed with tapering front and rear portions, a work table having a work supporting surface even with the mounted matrix integral with or affixed to a recessed interlocking member, the recess in said member being shaped to nest the tapered front portions respectively of the clamp and matrix when their tapered rear portions project into correspondingly shaped recesses formed in the chill plate, and spring plunger means yieldably holding the member connected to the chill plate and relatively displaceable to permit detachment of the matrix from the chill plate and/or detachment of the chill plate from the clamp.

* * * * *

UNITED STATES PATENT OFFICE

CERTIFICATE OF CORRECTION

Patent No. 4,063,527 Dated Dec. 20, 1977

Inventor(s) Gorini et al

It is certified that error appears in the above-identified patent and that said Letters Patent are hereby corrected as shown below:

Column 14, Claim 19, Line 1, delete "19" and insert --18--

Signed and Sealed this

Ninth Day of May 1978

[SEAL]

Attest:

RUTH C. MASON
Attesting Officer

LUTRELLE F. PARKER
Acting Commissioner of Patents and Trademarks